US006967299B2

(12) United States Patent
Howie et al.

(10) Patent No.: US 6,967,299 B2
(45) Date of Patent: Nov. 22, 2005

(54) MEMBRANE SWITCH WITH RIGID FASCIA

(75) Inventors: Malcolm Howie, Foxborough, MA (US); Jiianming Huang, Windhan, NH (US)

(73) Assignee: Ark-Les Corporation, Stoughton, MA (US)

( * ) Notice: Subject to any disclaimer, the term of this patent is extended or adjusted under 35 U.S.C. 154(b) by 0 days.

(21) Appl. No.: 10/844,646

(22) Filed: May 13, 2004

(65) Prior Publication Data

US 2005/0061649 A1 Mar. 24, 2005

Related U.S. Application Data

(60) Provisional application No. 60/504,921, filed on Sep. 22, 2003, provisional application No. 60/520,206, filed on Nov. 14, 2003.

(51) Int. Cl.[7] ..... H01H 13/70
(52) U.S. Cl. ..... 200/512; 200/296
(58) Field of Search ..... 200/5 A, 511–517, 200/296

(56) References Cited

U.S. PATENT DOCUMENTS

| | | | | | |
|---|---|---|---|---|---|
| 4,525,606 | A * | 6/1985 | Sado | 200/5 A |
| 4,901,074 | A * | 2/1990 | Sinn et al. | 341/22 |
| 5,401,922 | A * | 3/1995 | Asta | 200/5 A |
| 5,574,623 | A * | 11/1996 | Girard | 361/627 |
| 5,747,757 | A * | 5/1998 | Van Zeeland et al. | 200/5 A |
| 5,929,401 | A * | 7/1999 | Flegeo et al. | 200/5 A |
| 6,380,497 | B1 * | 4/2002 | Hashimoto et al. | 200/5 A |
| 6,563,435 | B1 * | 5/2003 | Platz | 341/34 |

* cited by examiner

*Primary Examiner*—Michael A. Friedhofer
(74) *Attorney, Agent, or Firm*—Quarles & Brady LLP

(57) ABSTRACT

A membrane switch provides a substantially rigid front fascia without the need for flexure limiting standoffs or the like. The membrane switch may use thin, printed insulating dots whose pattern controls the force required to actuate the switch elements as a function of distance from the switch elements preventing multiple activations.

15 Claims, 3 Drawing Sheets

MEMBRANE SWITCH WITH RIGID FASCIA

CROSS-REFERENCE TO RELATED APPLICATIONS

This application is based on and claims the benefit of U.S. Provisional application 60/504,921 filed Sep. 22, 2003, and U.S. Provisional application 60/520,206 filed Nov. 14, 2003, both hereby incorporated by reference.

STATEMENT REGARDING FEDERALLY SPONSORED RESEARCH OR DEVELOPMENT

BACKGROUND OF THE INVENTION

The present invention relates to electrical membrane switches and in particular to a membrane switch having or adhered to a substantially rigid front surface or fascia.

Membrane switches are well known in the art and normally employ a pair of stacked flexible membranes having opposed contacts printed on their facing surfaces. A spacer layer separates the membranes, except at a region about the contacts, allowing pressure from a finger or the like to deform one of the membranes so that its contact touches the contact of the other membrane closing an electrical switch. The natural resilience of the membranes may separate the contacts once the force of closure is removed. Electrical conductors, also printed on the facing surfaces of the membranes, communicate electrical signals to and from the contacts.

Normally, a thin plastic decorative trim is adhered to the front surface of the membrane switch to indicate the position of the buttons and their functions to the user.

A single membrane may support many contacts making membrane switches a cost effective solution for multi-switch control panels and the like. The continuous front membrane of a membrane switch seals the switch contacts from contamination, and for this reason, membrane switches are often used in environments where moisture or contaminants are a problem.

Membrane switches have some drawbacks. While the membrane itself is resistant to contamination and readily cleaned, it is soft and susceptible to abrasion or damage. The membranes must often be applied over the outer housing of an appliance or other device where they are exposed to damage. The common look and feel of thin plastic membrane can be limiting to designers experimenting with a wider range of design aesthetics.

The problem of damage to the membranes is addressed in U.S. Pat. No. 5,747,757 to Van Zeeland which describes positioning a membrane switch behind a thin panel of metal to resist vandals. Van Zeeland also suggests alternative use of plastics such as Lucite, Kevlar, or glass. As noted by Van Zeeland, the rigid panel tends to spread the force of actuation by a finger, or the like, over a broader area creating a risk that adjacent switches will be simultaneously actuated by a single touch. Van Zeeland addresses this problem using rigid standoffs or similar structures between the front panel and a back support that resists the deflection of the front panel except at the contact areas, thereby attempting to focus the deflection of the front panel to the contact areas.

Limiting the natural deflection of the front panel increases the force required to deflect the front panel to an amount which may be unacceptable to the average user.

The standoff system proposed by Van Zeeland also increases the complexity of manufacture of the membrane switch requiring specialized mechanical components that must be changed for each changed layout of the switch. The problems of supporting these standoffs against the minor deflections they must resist presents additional barriers to the use of the Van Zeeland design.

BRIEF SUMMARY OF THE INVENTION

The present inventors have created a rigid fascia membrane switch that can work with or without mechanical structure between the fascia and the rest of the membrane switch to restrain the deflection of the fascia, and that may work with a wide variety of fascia including curved fascia, and that provides simplified assembly.

Generally, the invention employs an ultra-sensitive design where the membranes are separated by thin insulating dots, for example, printed on the membrane, rather than employing a thicker plastic spacer layer. The dots reduce the actuation force (and actuation movement) required to activate the switch and also allow the actuation force and movement to be carefully tailored to accommodate force-spreading by the fascia. This tailoring can be done by changing the density of the dot patterns to decrease the sensitivity of the switch as one moves away from the contact area. The result is a membrane switch that can be used with a variety of fascia materials and with planar or curved fascias without requiring undue finger pressure for actuation.

Specifically, the present invention provides an electrical switch assembly having a substantially rigid front panel positioned in front of a membrane switch in contact with the front panel, the membrane switch providing a plurality of spatially separated switch elements. A backer plate is positioned behind the membrane switch in contact with the membrane switch and the space between the front panel and the backer plate is substantially free of structure intended to resist deflection of the front panel.

Thus, it is one object of one embodiment of the invention to provide a membrane switch for use with a substantially rigid front panel that does not require specialized structure to resist movement of the front panel.

The front panel may alternatively be a rigid plastic such as a polycarbonate plastic or glass or other rigid material.

It is thus one object of another embodiment of the invention to provide designers with a variety of different surface materials for membrane switches.

The front panel may be non-planar, for example, outwardly convex.

Thus, it is another object of an embodiment of the invention to provide a membrane switch that may be integrated into flowing or curved designs without inset of a flat control panel.

The separator used in the membrane switch may have a thickness to allow the membrane switch to actuate with a very small deflection of the fascia, for example, 0.001".

Thus, it is another object of an embodiment of the invention to provide a highly sensitive membrane switch that may be used with substantially rigid front panel materials.

The printed insulator elements may have a varying pattern density depending on the distance of the elements from the centers of the switch contacts.

It is thus another object of an embodiment of the invention to provide a simple method of controlling the actuation force of the membrane switch such as may be used to assist in preventing cross actuation of closely adjacent switch elements.

A movable switch operator may be positioned in front of the rigid front panel to be pressed by a user and to apply increased pressure to the switch area.

Thus it is another object of at least one embodiment of the invention to provide a simple mechanism to modify the forces applied to the rigid material required by different applications.

The switch areas may be separated along a first axis, and the electrically independent conductive switch contacts are proportionally narrower along the first axis than along a perpendicular to the first axis.

Thus it is another object of the invention to accommodate the force spreading produced by a rigid front panel while preserving desired switch spacings and contact areas.

These particular objects and advantages may apply to only some embodiments falling within the claims and thus do not define the scope of the invention.

DETAILED DESCRIPTION OF THE PREFERRED EMBODIMENT

Figure 1:
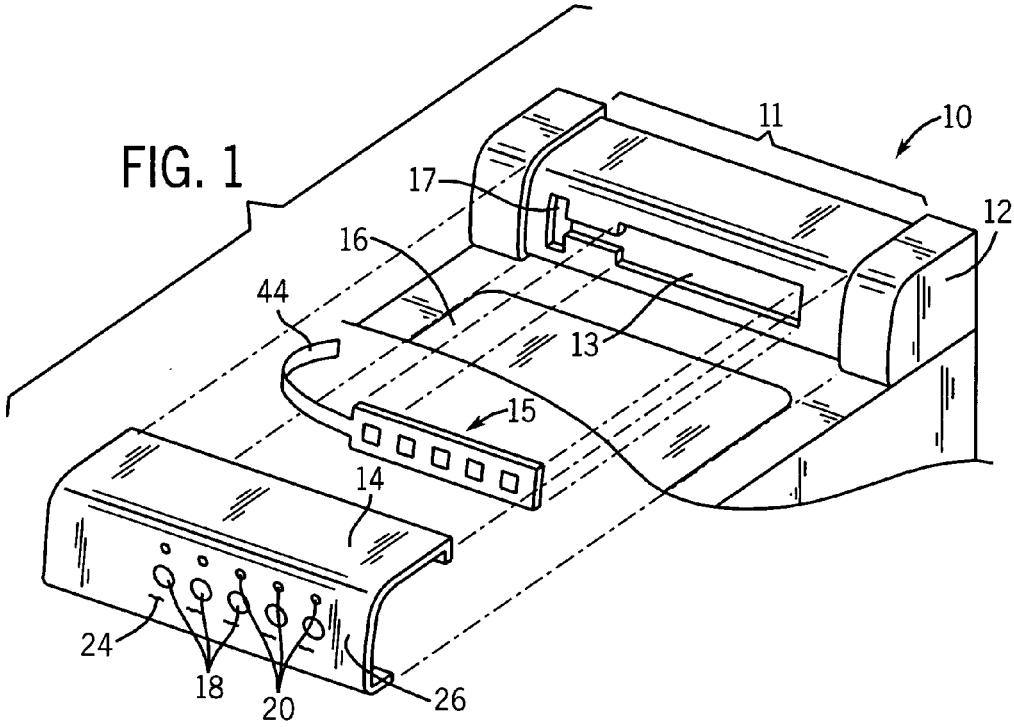
FIG. 1 is an exploded, perspective fragmentary view of a washing machine console using the present invention.

Referring now to FIG. 1, an appliance 10, for example, a top loading washing machine may provide a rearward upwardly extending console 12 having a fascia 14 facing the user from behind a tub access door 16 or the like.

The fascia 14 may be a metal cowling fitting over a recessed portion 11 of the console 12 to cover a recess 13 in a front face of the console 12 that provides a space for a membrane switch assembly 15 that will fit behind the control surface as will be described. The membrane switch assembly 15 provides a tail 44 that may pass through an opening 17 through the front face of the console 12 to connect the membrane switch assembly 15 to control electronics (not shown) positioned within the console 12.

The fascia 14 may be outwardly convex, for example, formed of 0.019-inch thick aluminum sheet supported by the console 12. The fascia 14 is a rigid material, meaning generally that it retains its shape without support and is much stiffer than a conventional plastic membrane of the type used in a membrane switch, for example, to resist folding under light finger pressure. Other metals, plastic, and glass may also be used for the fascia 14.

Exposed at the front of the fascia 14 may be a series of actuation positions 18 and indicator lights 20, the latter providing visual indication that the actuation positions 18 have been activated. The locations of the actuation positions 18 may be indicated by a simple graphics 24 printed on or etched in the fascia of the appliance 10. The graphic 24 may provide a target location for finger pressure and/or a descriptive legend.

Small holes may be cut through the fascia 14 for the indicator lights 20, however, otherwise, the fascia 14 may present a substantially outer surface that is resistant to water and detergent, and that allows drainage of splashed liquids.

Figure 2A:
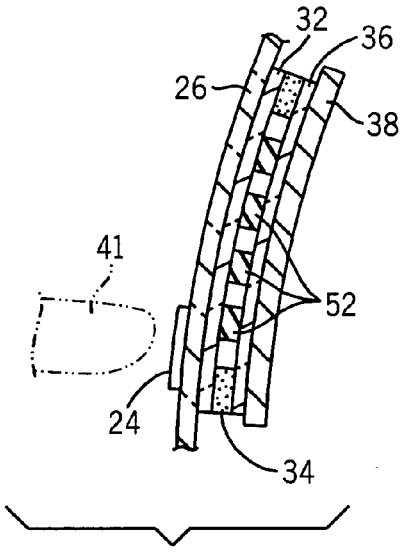
FIG. 2*a* is a cross sectional view through the console of FIG. 1 showing a first embodiment of the invention not providing indicator lights.

Referring now to FIG. 2, the material of the fascia 14 provides a front panel 26 for the actuation positions 18. Attached to the rear surface of the front panel 26 is a front membrane 32 forming part of a membrane switch assembly 15 and being of conventional material and structure. An adhesive (not shown) may attach the front membrane 32 to the rear of the front panel 26. Behind front membrane 32 is a rear membrane 36. The membranes 32 and 36 may be, for example, a polyester film of a type well known in the art.

The front membrane 32 and rear membranes 36 are held together at their periphery by adhesive 34 and separated within their peripheries by dielectric dots 52 as will be described below. Conductor patterns (not shown in FIG. 2) are printed on the inner, facing surfaces of the front membrane 32 and rear membrane 36. In use, a person may press the graphic 24 with his or her finger 41 causing a slight deformation of the front panel 26 and corresponding compression of the front membrane 32 against the rear membrane 36 activating the membrane switch.

A rear support 38, generally conforming to the curvature of the front panel 26, stiffens the front membrane 32 and rear membrane 36 and is attached to the front panel 26 by brackets (not shown) or may be a front face of the recess 13 or may be attached to the front panel 26 via the intervening layers of front membrane 32 and rear membranes 36 to provide some resistance to backward motion. The rear membrane 36 and rear support may be combined and replaced as a stiff printed circuit board, particularly when the desired form of the fascia 14 is flat rather than curved in which case a separate rear support 38 is not needed.

Figure 2B:
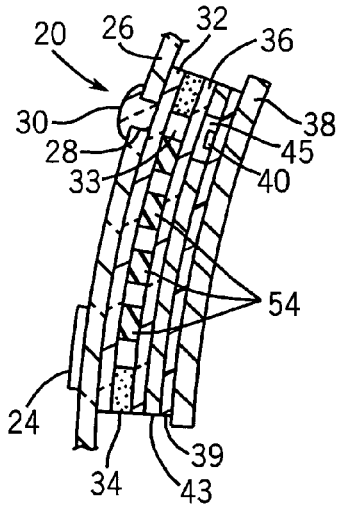
FIG. 2*b* is a figure similar to that of FIG. 2*a* of a second embodiment of the invention providing indicator lights.

Referring now to FIG. 2*b*, in an alternative embodiment, small holes 28 may be cut in the front panel 26 above the graphic 24 at the locations of the indicator lights 20, each fitted with a small transparent window 30. Front membrane 32 and intermediate membrane 36 may be transparent and free of light blocking materials in the region of the indicator lights 20 to allow passage of light therethrough from a light emitting diode (LED) 40. The LED 40 is attached to and extends from a front surface of a rear membrane, or printed circuit board 39. A spacer layer 43 attaches the rear membrane or printed circuit board 39 to the rear surface of the intermediate membrane 36 and provides a hole 45 receiving the LED 40 therein to space the front surface of the LED 40 from protruding into the rear surface of the intermediate membrane 36. Control circuitry (not shown) may be provided that causes the LED 40 to illuminate with alternate pressings of the associated switch to indicate that the switched function is on, as is generally understood in the art.

Figure 3:
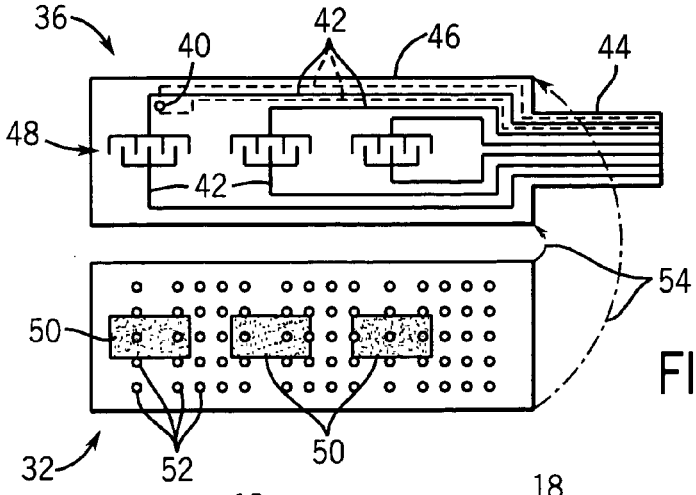
FIG. 3 is a front elevational view of the rear membrane of the membrane switch of FIG. 2*b* and a rear elevational view of the front membrane of the membrane switch of FIG. 2*b* showing conductive traces, contacts, and opposed shorting pads separated by insulating dots.

Referring now to FIG. 3, a front surface of the rear membrane 36 includes a set of conductive traces 42 leading from the tail 44 being an extension of the rear membrane 36. The conductive traces 42 pass from the tail 44 to a generally rectangular body portion 46 of the rear membrane 36 and there form an interdigitated contact pattern 48 exposed at that front surface of the rear membrane 36 at the location of each pushbutton 18. The front surface of the rear membrane 36 may also support the LEDs 40 (only one shown for clarity) and associated conductive traces 42 shown by dotted line. The traces 42 may be printed in silver or other suitable material.

A rear surface of the front membrane 32, such as is normally adjacent to the front surface of the rear membrane 36, provides shorting pads 50 spanning the interdigitated contact patterns 48. When pressure is applied to the front membrane 32 at the points of the shorting pads 50, the shorting pads 50 contact the interdigitated contact patterns 48 shorting the interdigitated contact patterns 48 and allowing for electrical flow between two associated conductive traces 42. The shorting pads 50 may be carbon or other suitable material.

Inadvertent shorting of the interdigitated contact patterns 48 by the shorting pads 50 is prevented not by a spacer layer, but by a series of insulating or dielectric dots 52 printed on the rear surface of the front membrane 32 atop of the shorting pads 50 and the areas around the shorting pads 50. Alternately the dielectric dots 52 can be printed on the front surface of the rear membrane 36. As described above, adhesive 34 selectively printed around the perimeter of either the front membrane 32 or the rear membrane 36 may attach the front membrane 32 to the rear membrane 36 as indicated by arrows 54.

The spacing between the dielectric dots 52, describing a "dot density" varies, as will be described below, to control the amount of activation force that will cause the front membrane 32 and rear membrane 36 to contact each other. The number of dielectric dots 52 per square inch may be freely varied to provide accurate control, both of the activation force of the switch and of the change in activation force as a function of location. A solid covering of dielectric can also be placed anywhere it is undesirable to have a switch activation.

Conventional membrane switches employ a spacer layer that may be as much as 0.005 to 0.01" thick. In the present invention, the dielectric dots have a thickness of less than 0.002" and preferably approximately 0.001" allowing a comparable small deflection to activate the switch formed by the shorting pads 50 and the interdigitated contact patterns 48.

It will thus be understood that without necessarily constraining the deflection of front panel 26 against flexure, the activation area around the actuation positions 18 may be controlled simply by the spacing of the dielectric dots 52. Note that rear support 38 need not be perfectly stiff.

Other methods to reduce or eliminate false triggering of the switches may also be employed together with or instead of the varying of the spacing of the dielectric dots 52, for example, including signal processing techniques that assign priorities to particular buttons when multiple buttons are struck or that select the first button to be struck within a predetermined window of time locking out other pressings, or that use anti-bounce techniques or the like to filter false hits.

Figure 4:
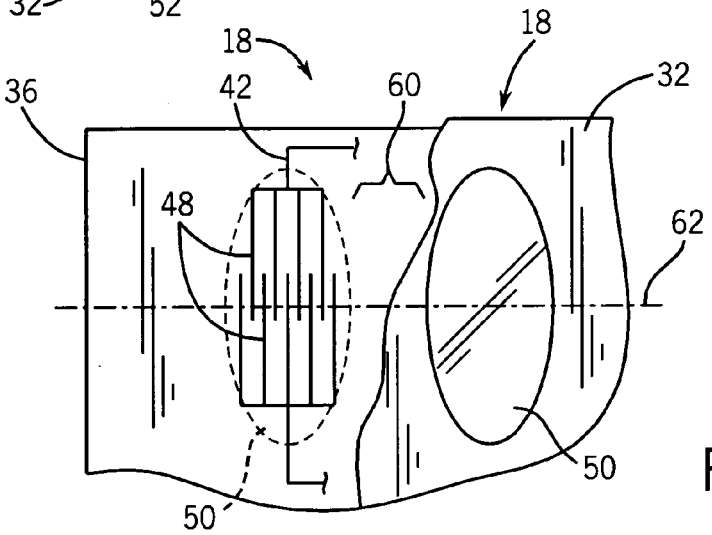
FIG. 4 is a fragmentary view of the membrane switch assembly of FIG. 1 showing an embodiment with asymmetrical contacts to accommodate force spreading by a rigid front panel.

Referring now to FIG. 4, the rigidity of the front panel 26 will cause some force spreading that requires a margin 60 separating interdigitated contact patterns 48 of the actuation positions 18 to prevent triggering of adjacent actuation positions 18 when a given pushbutton 18 is pressed. For closely spaced actuation positions 18, this margin 60 can adversely reduce contact area between shorting pads 50 and interdigitated contact patterns 48. Accordingly, the present invention contemplates that the area of the shorting pads 50 and interdigitated contact patterns 48 can be increased by extending the relative proportion of both along an axis perpendicular to an axis 62 along which actuation positions 18 are separated. As shown in FIG. 4, the shorting pads 50 may in one embodiment be oval having their longer axis vertical and perpendicular to a horizontal axis 62 of separation. Other asymmetric shapes may also be used for this purpose.

Figure 5:
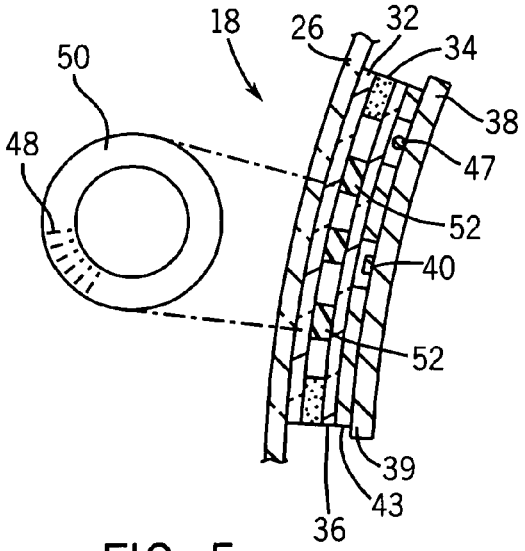
FIG. 5 is a figure similar to that of FIG. 2*b* of an embodiment having a clear front panel and annular switch contacts such as allow central illumination of each switch.

Referring now to FIG. 5 in one embodiment, the front panel 26 may be a transparent material such as glass or plastic. In this case, the shorting pad 50 and interdigitated contact patterns 48 may be constructed to have an annular form when printed on the rear surface of membrane 32 and front surface of membrane 36. The annular form of the shorting pad 50 and interdigitated contact patterns 48 allows light from LED 40 (described above) to pass through transparent membrane 32 and 36 and through the center of the shorting pad 50 and interdigitated contact patterns 48 to provide a visible illumination centered in the area of the actuation positions 18. In this example, the rear support 38 is formed by rigid material of the printed circuit board 39. The printed circuit board 39 may also hold other electrical components 47 such a resistors, diodes or transistors or the like and may stand in lieu of the second membrane 36 to support electrical contacts.

Figure 6:
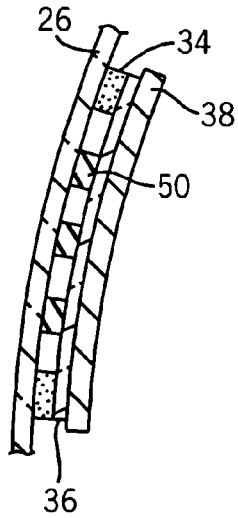
FIG. 6 is a figure similar to that of FIG. 2*a* showing an embodiment in which the front panel supports switch contacts.

Referring now to FIG. 6, in another embodiment, the front membrane 32 may be eliminated by using the front panel 26 to support the shorting pad 50 or in the case of a metallic front panel 26 to serve as the shorting pad 50 itself. In the case that the front panel 26 is an insulating material such as plastic, the shorting pad 50 may be printed on the rear surface of the front panel 26 using techniques similar to those used to print the membrane 32.

Figure 7:
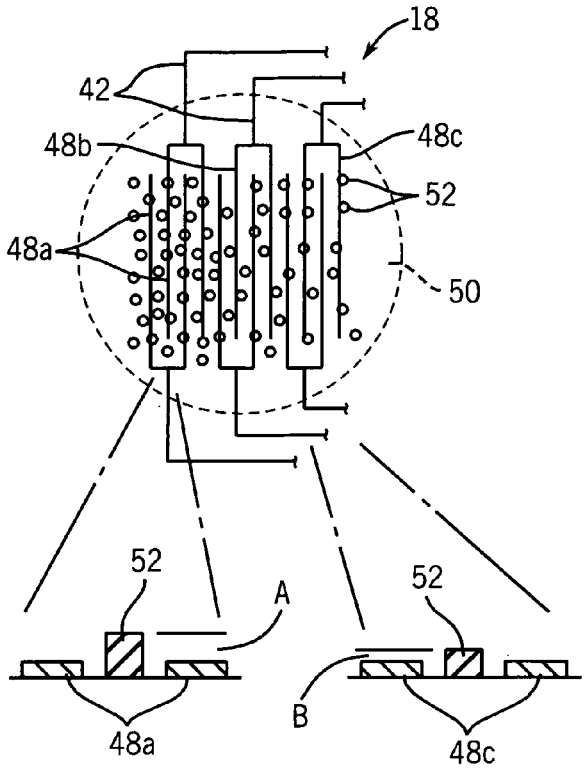
FIG. 7 is a top plan view of one membrane of a switch according to one embodiment of the invention showing implementation of multilevel force sensitivity.

Referring now to FIG. 7, the interdigitated contact patterns 48 associated with one pushbutton 18 may be constructed to provide three electrically isolated sets of interdigitated contact patterns 48*a*–48*c*, all operating in the region of one pushbutton 18 with a common shorting pad 50. Each electrically isolated set of interdigitated contact patterns 48*a*–48*c* may have a different activation pressure threshold defined as the pressure at which they contact electrically upon compression on the membranes 32 and 36.

In one embodiment, these different pressure thresholds may be produced by using dielectric dots 52 of different heights above the conductors of the interdigitated contact patterns 48. For interdigitated contact pattern 48*a*, taller dielectric dots 52 require greater activation pressure thresholds than the shorter dielectric dots 52 associated with interdigitated contact pattern 48*c*.

Alternatively or in addition, as also shown in FIG. 7, the separation distance between the dielectric dots 52 may be changed to provide differences in activation pressure thresholds among the interdigitated contact patterns 48*a*–48*c* with a greater separation distance between the dielectric dots 52 corresponding to lower activation pressure thresholds.

In these ways, a single pushbutton 18 may distinguish among no pressure and at least two compressive different activation pressures applied to membranes 32 and 36.

In an alternative embodiment, the different interdigitated contact patterns 48*a*–48*c* may be arranged on different layers of the switch to be separated along the axis of the pressing of the pushbutton 18.

Figure 8:
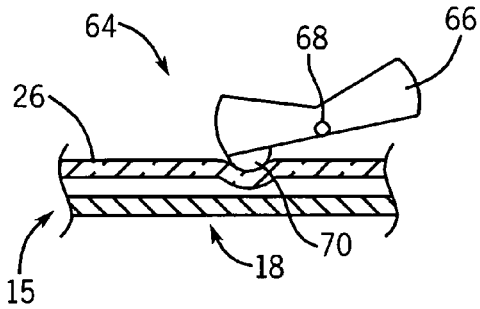
FIG. 8 is a partial cross-sectional view through the switch of the present invention showing additional use of a rocker operator to flex the front panel.

Referring now to FIG. 8, the front panel 26 may have a switch operator 64 attached to it, in this case, a rocker operator 66 pivoting about a pivot 68 attached to the front panel 26. The rocker operator 66 has a rearwardly extending cam 70 positioned so that tipping of the rocker operator 66 presses the cam 70 against the front panel 26 concentrating force of a finger pressure at the region of the pushbutton 18 as well as increasing that force by mechanical advantage.

Figure 9:
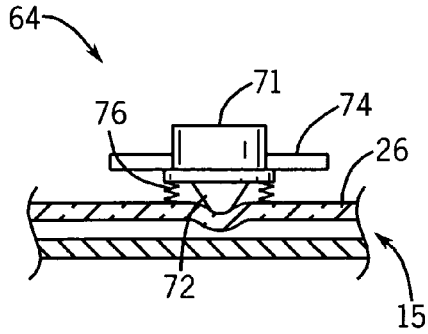
FIG. 9 is a figure similar to that of FIG. 8 showing a button operator used to flex the front panel.

Alternatively as shown in FIG. 9, a pushbutton operator 71 may be employed having a rearward extending point 72 held by a cowling 74 against the outward urging of a biasing compression spring 76. Pressing the pushbutton operator 71 pushes the point 72 against front panel 26 concentrating force at the location of the pushbutton 18.

Figure 10:
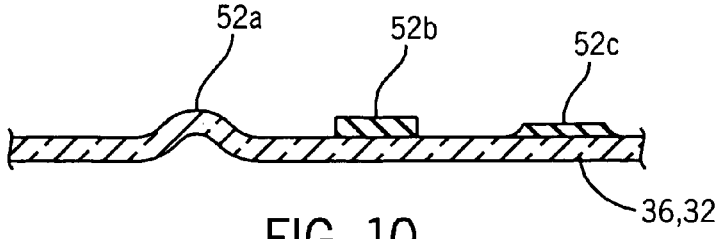
FIG. 10 is a cross-sectional view through a rear membrane of the switch showing different methods of producing islands of insulation.

Referring now to FIG. 10, the dielectric dots 52 are of arbitrary shape providing discrete islands of insulation that may be varied both in height and in spatial density. In one embodiment the dielectric dot 52*c* may be printed using an insulating ink or adhesive. Alternatively the dielectric dots 52*b* may be an element of insulating film, for example, polyester, die- or otherwise cut or perforated to provide for the necessary regions of insulation. In this case, the discrete dielectric dots 52*b* may be joined by a network of material to position them with respect to each other and to simplify assembly. Alternatively dielectric dots 52*a* may be embossments or deformations in either of membranes 32 or 36. The dielectric dots 52 need not be of a particular shape or arranged at regular locations.

It is specifically intended that the present invention not be limited to the embodiments and illustrations contained herein, but include modified forms of those embodiments including portions of the embodiments and combinations of elements of different embodiments as come within the scope of the following claims.

We claim:

1. An electrical switch assembly comprising:

a substantially rigid front panel;

a membrane switch positioned behind the front panel in contact with the front panel, the membrane switch providing a plurality of spatially separated switch elements; and a backer plate positioned behind the membrane switch in contact with the membrane switch at a rear surface of the membrane switch;

wherein a space between the front panel and the rear surface of the membrane switch is substantially free of structure confining deflection of the front panel to an area of the switch elements.

2. The electrical switch assembly of claim 1 wherein the front panel is a panel of sheet metal.

3. The electrical switch assembly of claim 1 wherein the front panel is a rigid plastic.

4. The electrical switch assembly of claim 1 wherein the front panel is glass.

5. The electrical switch assembly of claim 1 wherein the front panel is non-planar.

6. The electrical switch assembly of claim 5 wherein the front panel is outwardly convex.

7. The electrical switch assembly of claim 1 wherein the membrane switch actuates with a deflection of less than 0.002 inches.

8. The electrical switch assembly of claim 1 further including a movable switch operator positioned in front of the rigid front panel to be pressed by a user and to apply increased pressure to the switch area from that pressing by a user.

9. The electrical switch assembly of claim 1 wherein the rigid front panel is transparent and further including a lamp behind the front panel.

10. The electrical switch assembly of claim 9 wherein the backer plate is a printed circuit card holding the lamp.

11. An electrical switch assembly comprising:

a substantially rigid front panel supporting on a rear surface at different switch locations conductive first switch contacts; and a backer element positioned behind the front panel in contact adjacent to the front panel and supporting on a front surface at the different switch locations second switch contacts connectable to the first switch contacts with deflection of the front panel;

wherein the first switch contacts are metal of the front panel.

12. An electrical switch assembly comprising:

at least two adjacent sheets supporting at a switch area multiple electrically independent conductive switch contacts upon opposed surfaces of the sheets to contact each other when the sheets are pressed at the switch area wherein one sheet is a substantially rigid front panel;

a plurality of dielectric dots separating the conductive switch contacts, the dielectric dots spaced apart provide a contacting of the conductive switch contacts at different thresholds of pressure when the sheets are pressed at the switch area;

wherein a switch distinguishing between no pressure and at least two levels of compressive pressure is provided.

13. The electrical switch assembly of claim 12 wherein the dielectric dots near different contacts are of different thickness to provide the different thresholds of pressure.

14. The electrical switch assembly of claim 12 wherein the dielectric dots are of different separations from one another to provide the different thresholds of pressure.

15. The electrical switch assembly of claim 12 wherein the rigid front panel is positioned in front of two sheets supporting the switch contacts and pressure must be applied to the sheets through the rigid front panel.

* * * * *